United States Patent [19]

Foster

[11] Patent Number: 4,614,361

[45] Date of Patent: Sep. 30, 1986

[54] MULTIPLE PART SHIPPING LABEL

[76] Inventor: Robert S. Foster, 3417 Louisiana, St. Louis, Mo. 63118

[21] Appl. No.: 585,155

[22] Filed: Mar. 1, 1984

[51] Int. Cl.[4] ..... B41L 1/22; B42D 15/00

[52] U.S. Cl. ..... 282/8 R; 283/79; 283/81

[58] Field of Search ..... 282/8 R, 27 R, 1 R, 282/1 A; 283/79, 80, 81

[56] References Cited

U.S. PATENT DOCUMENTS 1,249,531 12/1917 Smith ..... 282/27 R 2,557,255 6/1951 Brown ..... 282/27 R

*Primary Examiner*—Paul A. Bell

*Attorney, Agent, or Firm*—Senniger, Powers, Leavitt and Roedel

[57] ABSTRACT

A shipping label comprising upper, lower and intermediate layers. The upper layer has a space thereon for entry of data and forms a stencil for subsequent transference of the data to a package to be shipped. The lower layer has an adhesive coating on its back surface for subsequent attachment of the lower layer to a shipping document and is disposed under and generally coincident with the upper layer. The lower layer has a score line extending partially therethrough so that the lower layer may be folded out of the way while the upper layer is used as a stencil. The intermediate layer is disposed between the upper and lower layers for transfer of the data entered on the upper layer to a predetermined portion of the lower layer.

3 Claims, 3 Drawing Figures

MULTIPLE PART SHIPPING LABEL

BACKGROUND OF THE INVENTION

This invention relates to shipping labels, and more particularly to multiple part shipping labels.

Conventional shipping forms or labels include a plurality of sheets connected together at their margins where one sheet is used as a label and the other sheets are used as receipts. The label is usually the same size as the receipt sheets and only used for labelling packages to be shipped. If there are a number of packages which need to be shipped to the same destination, a person must copy the information over each time to a separate label. This is obviously very time consuming.

Reference may be made to U.S. Pat. Nos. 3,987,960 and 4,343,492 for labels or forms generally in the field of this invention.

SUMMARY OF THE INVENTION

Among the several objects of the invention may be noted an improved multiple part shipping label which has an upper layer that may be used as a stencil for easy transference of data to a package or the like; the provision of such a label which has a lower layer including a predetermined portion that can be removed from the lower layer and be attached to a shipping document; and the provision of such a label which is simple to use and economical to manufacture.

In general the multiple part shipping label of this invention comprises upper, lower and intermediate layers. The upper layer has a space thereon for the entry of name and address data. Once the data is entered on the upper layer, it forms a stencil for subsequent transference of the data to a package to be shipped. The lower layer has an adhesive coating on its back surface for subsequent attachment of the lower layer to a shipping document or the like. The lower layer is disposed under and generally coincident with the upper layer and is separable therefrom. The lower layer has a score line extending at least partially therethrough so that the lower layer may be folded out of the way while the upper layer is being used as a stencil. The intermediate layer is disposed between the upper and lower layers for immediate transfer of the data entered on the upper layer to a predetermined portion of the lower layer, whereby said data need be entered only once.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
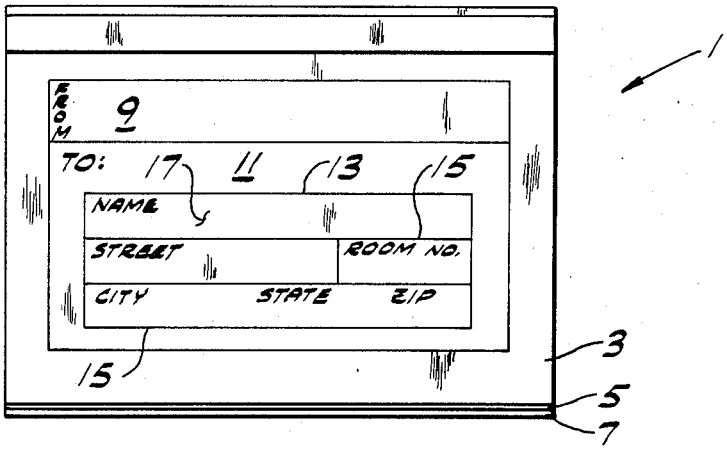
FIG. 1 is a top plan of a multiple part shipping label of this invention.
Figure 2:
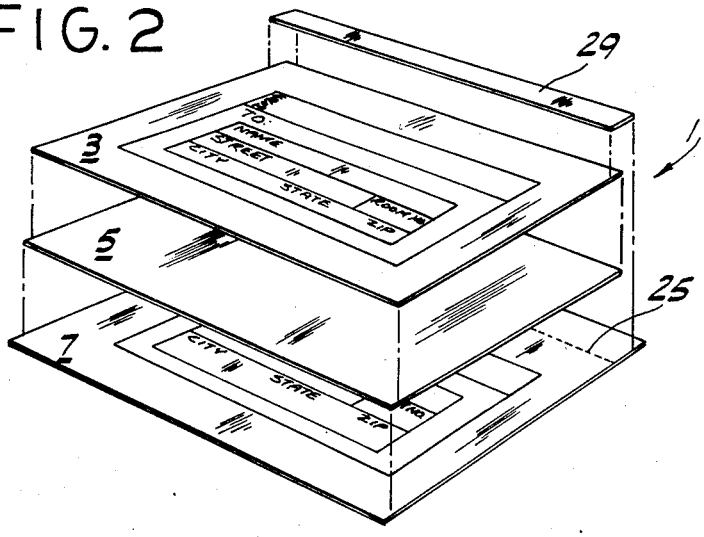
FIG. 2 is an exploded view of the shipping label.

Referring to the drawings, there is generally indicated at 1 a multiple part shipping label of this invention comprising upper, intermediate and lower layers 3, 5 and 7, respectively, which are generally rectangular in shape and adhered to each other along their top edges. As shown in FIGS. 1 and 2, the bottom edge of the shipping label 1 is stepped with the intermediate layer 5 being shorter than the lower layer 7 and the upper layer 3 is being slightly shorter than the intermediate layer 5. This stepping makes it very easy to separate the layers from each other.

The upper layer 3 has on its face suitable blocks 9, 11, 13, line 15 and space 17 for the entry of data such as name and address of the sender and addressee of the package. It will be understood that some of the data that is entered on the upper layer may be pre-printed on its face. For example, a business which ships many packages may wish to have its return address pre-printed on the upper layer. The upper layer 3 is made of a type of paper which allows it to be used as a stencil for subsequent transfer of the data placed thereon to a package or packages by the use of an ink roller or the like.

The intermediate layer 5 is a sheet of carbon paper or other type of copy-producing paper and is disposed between the upper and lower layers 3 and 7, respectively. However, a layer of carbon or like material could also be applied directly to the back surface of the upper layer 3 and used in lieu of a sheet of carbon paper.

Figure 3:
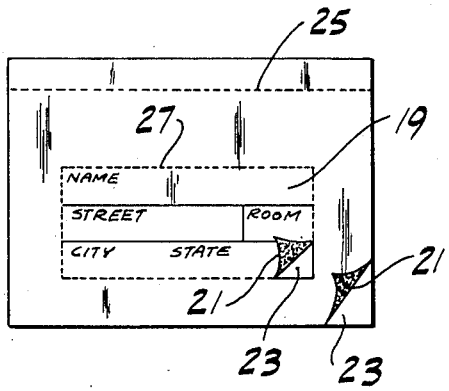
FIG. 3 is a top plan of a lower layer of the label and shows the adhesive backing of the layer.

The lower layer 7, as shown in FIGS. 2 and 3, has a predetermined portion or data block 19 on its face similar to block 13 of the upper layer 3. The data block of the lower layer is disposed under and generally coincident with the data block of upper layer 3. Information entered on the upper layer is transferred to the lower layer 7 by the intermediate layer 5 whereby the data need only be entered once. The lower layer also has an adhesive coating 21 on its back surface for subsequent attachment of the lower layer to a shipping document or the like. This coating can be any type of conventional pressure sensitive adhesive. A protective backing sheet 23 is releasably bonded to the back of the lower layer and is removed when attaching the lower layer to a shipping document or the like. The lower layer 7 further has a score line 25 extending partially therethough near the top edge of layer 7 so that the lower layer may be folded out of the way while the upper layer 3 is used as a stencil. The score line 25 also provides a line on which to tear along to remove the lower layer 7 from the multiple part label 1.

As seen in FIG. 3, the lower layer in one embodiment of the invention further has a die-cut 27 which extends around the predetermined portion 19 of the lower layer 7. Once the name and address of the addressee is entered thereon by transference of the data from the upper layer 3, the predetermined portion 19 can be removed from the lower layer by peeling it away. Since this portion is coated with adhesive on its back surface, it can be attached to a shipping record document or the like.

As best shown in FIG. 2, the layers 3, 5 and 7, are held together by an adhesive margin 29 or the like at their top edge.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A multiple part shipping label comprising:

an upper layer having a space thereon for the entry of name and address data, said upper layer comprising stencil paper, said stencil paper being adapted to form a stencil for subsequent transfer of said data to a package or packages by use of an ink roller or the like;

a removable lower layer having an adhesive coating on its back, said lower layer being disposed under and generally coincident with the upper layer and being separable therefrom, said lower layer having a line of weakness thereacross;

an intermediate layer disposed between the upper and lower layers for immediate transfer of data entered on said upper layer of a predetermined portion of said lower layer, whereby said data need be entered only once; and a die-cut line extending around said predetermined portion of the lower layer, whereby once said data is entered, the pre-determined portion of the lower layer having said data thereon may be removed from the remainder of the lower layer and attached to a shipping document or the like.

2. A multiple part shipping label as set forth in claim 1 wherein the adhesive coating on the back surface of the lower layer is a pressure sensitive adhesive coating, said lower layer being disposed with its back surface covered by a protective backing sheet, whereby said lower layer may be removed from the protective backing sheet and attached as a result of the application of pressure to a shipping document or the like.

3. A multiple part shipping label as set forth in claim 1 wherein the intermediate layer is a carbon sheet.

* * * * *